United States Patent [19]

Carlin

[11] Patent Number: 4,763,275

[45] Date of Patent: Aug. 9, 1988

[54] FORCE ACCUMULATING DEVICE FOR SPORTING PROTECTIVE GEAR

[76] Inventor: John A. Carlin, 1795 S. St. Paul, Denver, Colo. 80210

[21] Appl. No.: 831,653

[22] Filed: Feb. 20, 1986

[51] Int. Cl.[4] ..... G01M 7/00; G01D 9/00; G08B 23/00; A63B 69/00

[52] U.S. Cl. ..... 364/508; 364/550; 273/55 R; 273/1 GC; 273/148 R; 73/862.27; 73/862.62; 73/379; 340/323 R

[58] Field of Search ..... 364/508, 550, 551, 200, 364/900; 272/76, 98, 129, DIG. 5, DIG. 6, DIG. 9; 273/1 GC, 1 GE, 55 R, DIG. 28, 148 R; 73/379, 862.27, 862.62; 340/323 R

[56] References Cited

U.S. PATENT DOCUMENTS

| | | | |
|---|---|---|---|
| 3,302,214 | 2/1967 | Yuritch | 272/76 X |
| 3,866,909 | 2/1975 | De Santis | 272/76 |
| 3,972,238 | 8/1976 | Thatcher | 273/55 R |
| 4,029,315 | 6/1977 | Bon | 273/55 R |
| 4,170,225 | 10/1979 | Criglar et al. | 272/DIG. 5 X |
| 4,277,828 | 7/1981 | Tateishi | 364/415 |
| 4,358,118 | 11/1982 | Plapp | 273/1 GC |
| 4,367,752 | 1/1983 | Jimenez | 128/689 |
| 4,394,865 | 7/1983 | Sidorenko | 128/782 |
| 4,409,992 | 10/1983 | Sidorenko | 128/782 |
| 4,499,394 | 2/1985 | Koal | 310/330 |
| 4,534,557 | 8/1985 | Bigelow | 273/55 A |

FOREIGN PATENT DOCUMENTS

| | | | |
|---|---|---|---|
| 2741090 | 3/1979 | Fed. Rep. of Germany | 272/76 |
| 0267403 | 11/1967 | U.S.S.R. . | |
| 0598613 | 3/1978 | U.S.S.R. | 272/76 |

OTHER PUBLICATIONS

Rocky Mountain News Article by Scott Stocker entitled, "Escalating Helmet Cost Linked to Suits Over Football Injuries".

*Primary Examiner*—Parshotam S. Lall
*Assistant Examiner*—Joseph L. Dixon
*Attorney, Agent, or Firm*—Dorr, Carson, Sloan & Peterson

[57] ABSTRACT

A sensor capable of being adapted to sporting protective gear for sensing forces or vibrations encountered by the protective gear. The device senses the forces and delivers a signal proportional to the sensed force into a circuit for determining the accumulative force encountered by the protective gear over a period of time. The determining circuit is capable of decrementing the accumulated force according to a predetermined source-time pattern in order to allow the user of the sporting protective gear to recover. The accumulated force is sensed and as decremented is suitably displayed.

14 Claims, 9 Drawing Sheets

Fig. 9
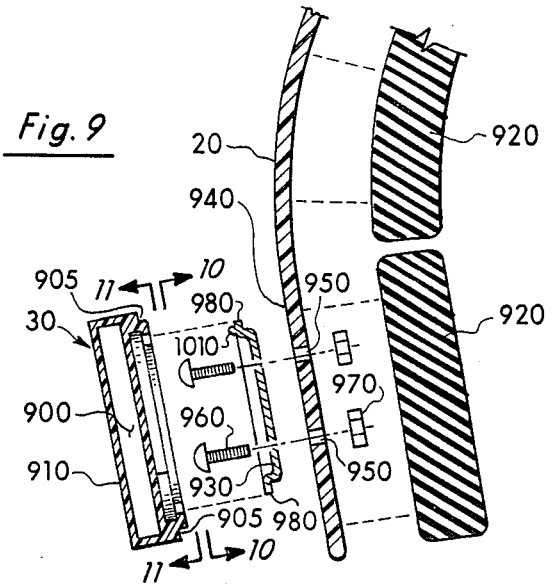
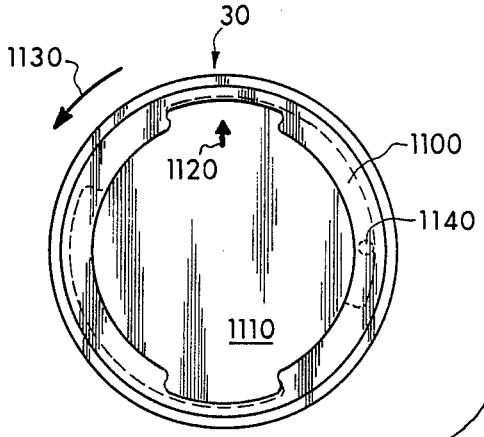
Fig. 11
Fig. 10
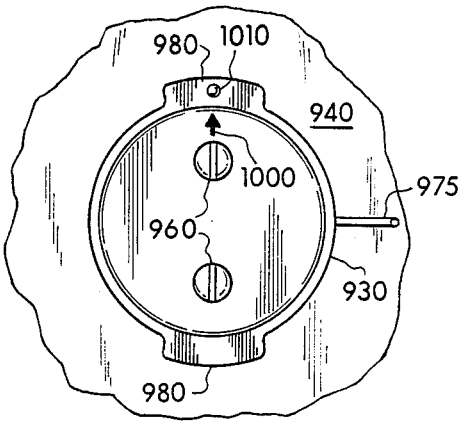

Fig. 20
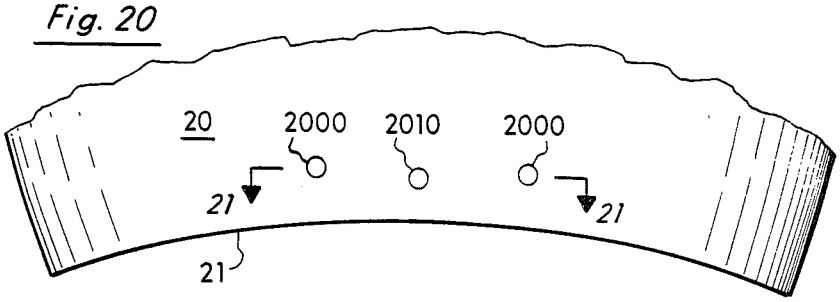
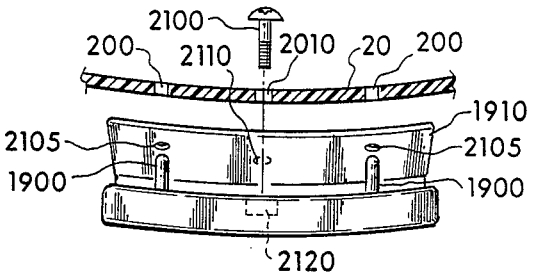
Fig. 21
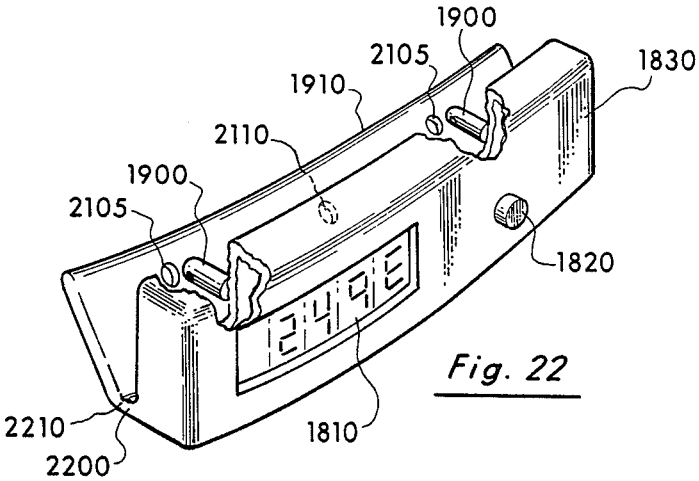
Fig. 22
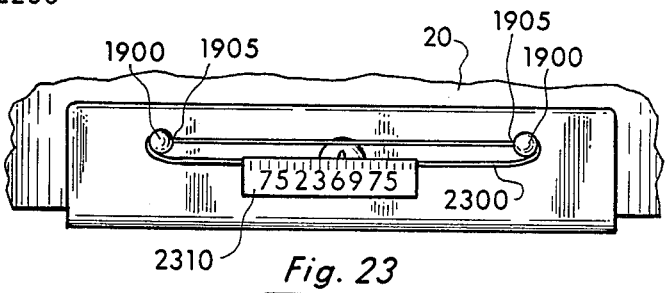
Fig. 23

FORCE ACCUMULATING DEVICE FOR SPORTING PROTECTIVE GEAR

BACKGROUND OF THE INVENTION

1. Related Invetions

The present invention is related to the following co-pending applications:

(a) Stride Evaluation System, Ser. No. 06/831,978, and (b) Improved Reaction Time and Force Feedback System, Ser. No. 06/831,979 filed concurrently with this invention.

2. Field of the Invention

The present invention relates to the field of sports and, more particularly, to a device attached to sporting protective gear, such as helmets, for indicating accumulated force.

3. Discussion of the Prior Art

The incidents of injuries to primarily high school sports, most especially football, is significant, costly, and harmful to the participant. As a result, equipment, such as football equipment, has been the subject of improvements and has been increasingly used to provide more protection. Unfortunately, head, neck and back injuries are still quite common causing many of the equipment manufacturers to go out of business because of litigation costs and lack of suitable insurance. See "Escalating, Costs Linked to Suits Over Football Injuries", Rocky Mountain News, June 27, 1985.

The present invention is not related to improving the actual physical equipment to provide greater protection, but rather sets forth a device for attaching to existing football helmets to more properly control the amount of accumulated force sustained by sport participants over a period of time. It is well known that the human body is more capable of becoming harmed through a series of forces applied quickly over time compared to the same series of forces applied more slowly over time. In other words, the human body recovers and is capable of sustaining more forces when the suitable recovery time is allowed.

The present invention, therefore, senses and indicates accumulated force and if the accumulated force exceeds a predetermined limit, produces an indication for an alarm. However, if no additional forces are created in the future, the device of the present invention decrements, periodically, the accumulated force. A high school football coach, for example, can easily view the indications of the present invention and sensibly use his players in a fashion whereby the accumulated sustained force is always below the predetermined level.

In the priorly issued patent entitled "Reaction Time and Applied Force Feedback", U.S. Pat. No. 4,534,557, issued on Aug. 13, 1985 to the present inventor, a reaction time and applied force feedback system for sports was disclosed wherein force sensitive sensors were placed on or in the physical sporting equipment. Such a system is useful for sensing forces in punching bags, footballs, blocking tackles, and martial arts kicking posts.

The present invention provides a force accumulating device attached to a sporting helmet for indicating accumulated force encountered by a sport participant using the helmet.

Prior to the filing of this application, the inventor conducted a patentability investigation for a system that feedbacks reaction time and applied force and which can be worn by the sporting participant. The following patents in addition to the above stated patent were uncovered in the search:

| Inventor | Reg. No. | Date |
|---|---|---|
| Bon | 4,029,315 | 6-14-77 |
| Tateishi | 4,277,828 | 7-7-81 |
| Jimenez et al | 4,367,752 | 1-11-83 |
| Sidorenko et al | 4,394,865 | 7-26-83 |
| Sidorenko et al | 4,409,992 | 10-18-83 |

The second patent issued to Sidorenko et al (U.S. Pat. No. 4,409,992) pertains to an electronic ergometer which is placed in the portable housing attached to the waist of a user. The disclosed ergometer converts the oscillations of the body center of gravity into a suitable electrical signal which is then processed. The disclosed ergometer is capable of measuring and registering the work performed by the user and for producing an audible and a visual signal indicating exhaustion of the body's reserve when a predetermined threshold of activity is achieved. The disclosed device provides for constant monitoring of the work performed by the user and is capable of measuring the power developed while walking, running, or jogging. The first Sidorenko et al. patent (U.S. Pat. 4,394,865), sets forth an apparatus for determining levels of physical loads also based upon the body center of gravity amplitude of oscillations created by a user. If the amplitude of movements of the user exceeds a certain minimum level, then one indicator is activated. If the amplitude of movements is above a certain optimum level, a second indicator is activated and if the movement is above a maximum level of physical load, a third indicator is activated.

In the 1983 patent issued to Jimenez et al (U.S. Pat. 4,367,752) is disclosed a system capable of measuring various parameters such as heart rate and the occurrence of stepping to arrive at a system which is capable of determining the physiological parameters of a runner or jogger.

The 1981 patent issued to Tateishi (U.S. Pat. No. 4,277,828) pertains to an analyzer for determining resulting forces at bone joints. The system is based upon geometric patterns derived from X-ray pictures. The 1977 patent issued to Bon (U.S. Pat. No. 4,029,315) sets forth a target generator for a thrown football in order to measure certain speed parameters.

None of the above approaches disclose an approach for determining accumulating the forces encountered by a helmet, indicating when a predetermined value of accumulated force is exceeded, and for decrementing the accumulated force over a period of time when the helmet is not in use.

SUMMARY OF THE INVENTION

My present invention sets forth a device of displaying accumulated force encountered by sports participants wearing protective gear in a sporting event. The device includes a sensor placed on the protective equipment for sensing forces or vibrations encountered by the protective gear. The output of the sensor is delivered into a circuit for determining the accumulated force encountered by the equipment over a period of time. The determining circuit is capable of decrementing the accumulated force according to a predetermined source-time pattern. The accumulated force as sensed and as decremented is suitably displayed.

BRIEF DESCRIPTION OF THE DRAWING

FIG. 9 is a cross-sectional view showing the assembly of the device of the present invention to a football helmet;

FIG. 10 is a rear planar view showing the mounting plate of the present invention on the football helmet;

FIG. 11 is a rear planar view of the device of the present invention;

FIG. 20 illustrates the location of the formed holes in the football helmet of the present invention;

FIG. 21 sets forth the connection of the device shown in FIG. 18 to a football helmet;

FIG. 22 sets forth a perspective view of the device shown in FIG. 18;

FIG. 32 sets forth the installation of the wire lock of the present invention having a serial number identification strip formed thereon; and FIG. 24 sets forth a state table for the control circuit of FIG. 16.

DETAILED DESCRIPTION

Figure 1:
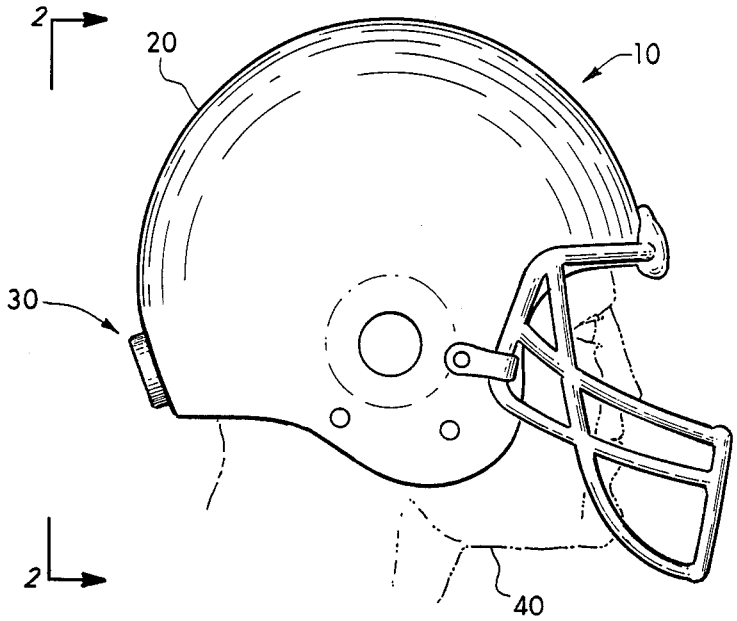
FIG. 1 is a side planar view of a football helmet having attached thereto the device of the present invention.
Figure 2:
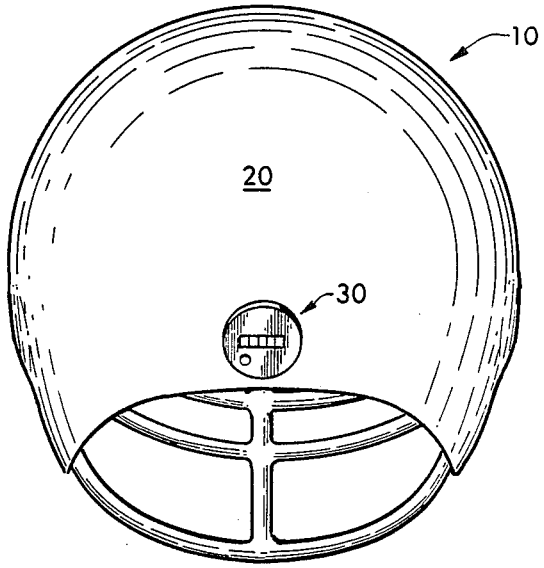
FIG. 2 is a rear planar view of the football helmet of FIG. 1 showing the positioning of the device of the present invention.

In FIGS. 1 and 2 is shown a conventional football helmet 10 having disposed on the back side 20 the indicator 30 of the present invention. The helmet 10 is being worn by a sport participant 40. The indicator device 30 of the present invention is designed to be installed on the football helmet 10 at the point of manufacture or, alternately, to be installed as a retrofit on existing football helmets 10. It is to be expressly understood that although a football helmet 10 is shown for purposes of illustration, the teachings of my present invention have application to any protective head or protective sporting gear such as, for example, boxing head gear, hockey helmets, and leg and knee braces.

Figure 3:
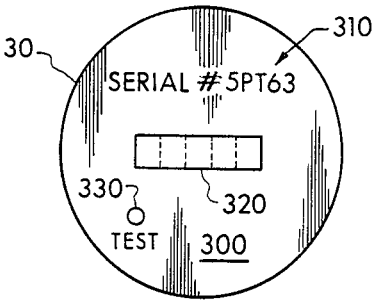
FIGS. 3–5 illustrate the indicator of the present invention exhibiting an increasing amount of force.
Figure 4:
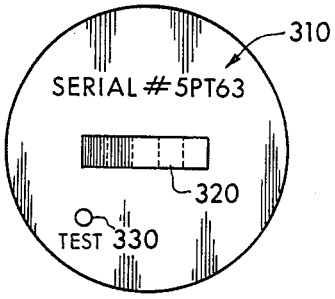
Figure 5:
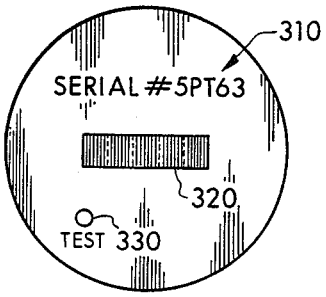

The external face 300 of the indicator 30 is shown in FIGS. 3 through 5 to include a serial number 310, an indicator or display 320 and a test button 330.

The purpose of the indicator device 30 of the present invention is to indicate the accumulative effect of force due to persistent sporting activity over a period of time. The purpose of the indicator 30 of the present invention is to accumulate force due to successively occurring force blows over a short period of time. The serial number 310 uniquely identifies the device and provides the owner of the equipment control over which indicators are assigned to a sporting participant.

The indicator 320 provides a visual indication of the accumulative amount of successive forces being applied to the helmet 10. In FIG. 3, no force is applied and the bar indicator shows zero force. In FIG. 4, two units of force are activated and in FIG. 5, a maximum of five units of force are indicated. A predetermined amount and magnitude of force equals a "unit." For example, 100 blows may be sensed but may only equal one unit if the blows are of relatively small magnitude. Conversely, perhaps only ten blows of much greater magnitude would equal a unit. And, of course, if a blow was of such sufficiency in magnitude to not only fully register the unit but exceed it, it would also be accumulated for the next unit. When the indicator 320 shows a maximum force as shown in FIG. 5, the player should be removed from the sporting activity until the indicator shows a safe zone such as shown in FIGS. 3 and 4. As will be explained subsequently, if a player having the full accumulative force indication as shown in FIG. 5 is removed from the game, electronics within the device 30, over a period of time, decrements the indicator unit by unit until a zero indication as shown in FIG. 3 is achieved. In other words, the body has recovered and is capable of sustaining more force. This is best explained through reference to FIGS. 6 and 7 wherein the vertical axis of the graph corresponds to the number of bar segments in the bar indicator 320 and the horizontal axis corresponds to suitable units of time. Such units of time could be minutes, hours, or days depending on the nature of the sport. For example, boxing helmets could use minutes of time whereas football helmets could use hours or days.

Figure 6:
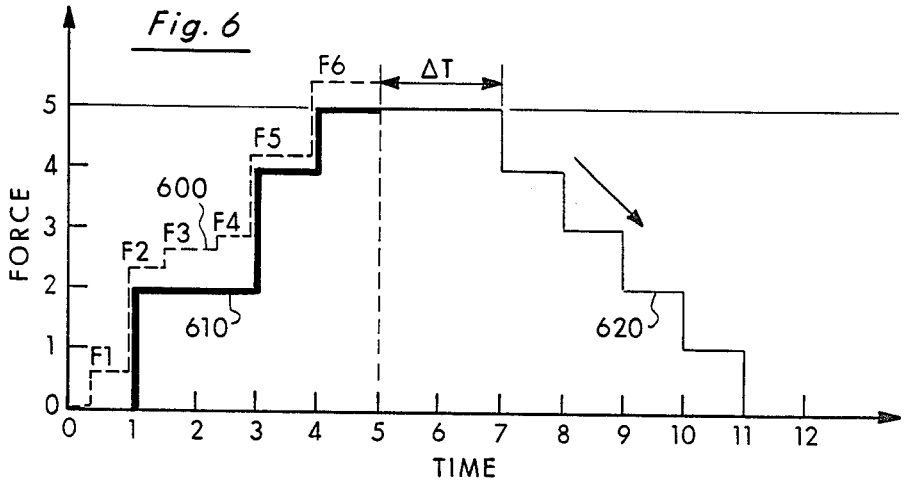
FIG. 6 is a graph showing the accumulating force exceeding a predetermined level.

Assume in FIG. 6 that a football player is struck sufficiently to achieve two units of force during time unit 1. Curve 600 depicts the actual accumulated force detected whereas curve 610 depicts the indicator reading. From T0 to T1, the helmet encounters two forces of sufficiency, F1 and F2. Two units of force are then indicated as shown in FIG. 4. Between T1 and T3, the helmet encounters forces F3 and F4, neither of which when combined together cause the indicator curve 610 to increment to force unit #3. Subsequently at time interval 3, the player encounters another force F5 resulting in four of the five segments being activated. Finally, at time unit 4 the player encounters another hit, F6, resulting in the display shown in FIG. 5. At this time (i.e., when the third blow of sufficiency is encountered and the indicator shows five units) an audible alarm may optionally be sounded to the wearer of the helmet that the maximum accumulated force has been obtained. A visual indication of this is provided on the back of a helmet for other players and for the coach to see. At this point in time, the player should be removed from the game in order for his head, neck area, and shoulders to physically recover. Assume, in FIG. 6 that the player is removed at time unit 5 because of the indication. The player would wait and not play until time unit 7 when the electronics within the device 30 decrements the indicator. Once the indicator shows that the player is in a safe range, he can re-enter the game at time units 8, 9, 10, or beyond. Curve 620 in FIG. 6 represents a predetermined force-time pattern for decrementing the indicator after sufficient time for the participant to recover is allowed. First a predetermined time, Delta T, passes and, then, the indication, in the example shown, is decremented one force interval for the passage of succeeding time unit.

Figure 7:
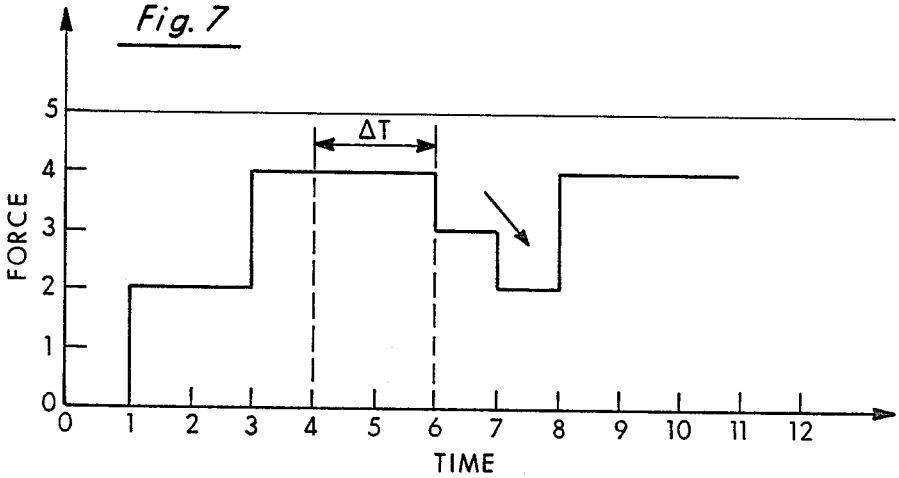
FIG. 7 is a graph showing the accumulated force always being below a predetermined level.

Assume the situation of FIG. 7 wherein the player at time unit 1 encounters a total of two units of force impact and then again at time unit 3 encounters an additional two accumulative units of force causing the indicator to display a total of four units of force. The player continues in the game and does not incur any additional hits. At time unit 6 and after the predetermined time, Delta T, the electronics of device 30 causes the indicator to decrement in the predetermined force-time pattern down one force unit and at time unit 7 it causes the indicator to decrement one more force unit. However, at time unit 8, the player encounters another two units of accumulated force causing the device to return to the four accumulated force units indication. As long as the blows and the time occurs within the range shown in FIG. 7, the player can continue the competitive engagement since the indicator shows the player is operating within a safe range of accumulated force.

It is to be understood that indicator 320 of the device 30 of the present invention provides a "relative level" of accumulated force. Furthermore, while a bar indicator has been illustrated in FIGS. 3–5, a digital readout could also be used.

Figure 8:
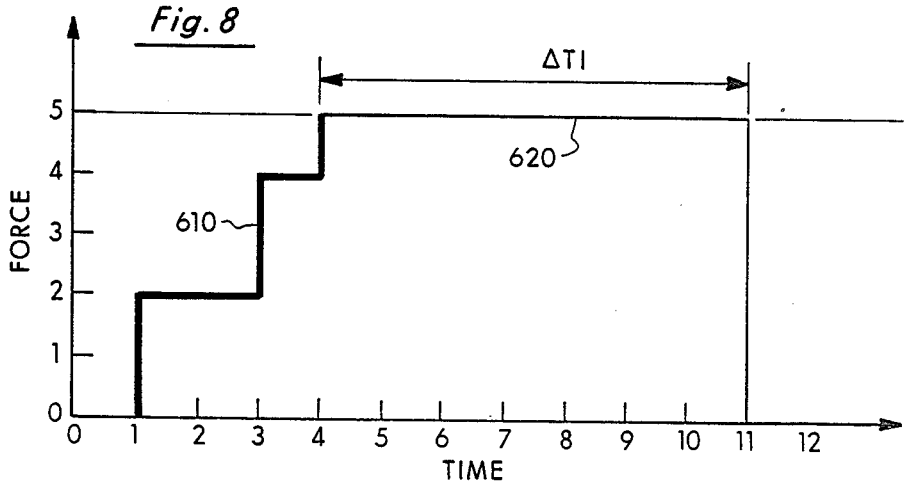
FIG. 8 is a graph showing the accumulated force exceeding a predetermined level for a predetermined period of time.

In FIG. 8, an optional approach to decrementing the indicator in a second predetermined force-time pattern is set forth. The situation of FIG. 8 initially corresponds to that shown in FIG. 6. However, a predetermined time, Delta T1, must elapse and the indicator must fully return to zero before the player is allowed to resume play. This approach provides a greater margin of safety and for body recovery.

In FIG. 9, the device 30 contains an electronics chamber 900 which is hermetically sealed within a housing 910. It is mounted to the backside 20 of a conventional football helmet 10 having suspended helmet padding 920 by means of a mounting plate 930 which is affixed to the back rear surface 940 of helmet 10. Holes 950 are formed in the back of the helmet surface 940 so that screws 960 and nuts 970 firmly hold the mounting plate 930 to the back 940 of helmet 10. The nuts 970 are preferably lock nuts and firmly hold the mounting plate 930 to the helmet 10. The mounting plate 930 has raised lips 980 on opposing ends thereof for selectively engaging device 30.

This is shown in FIGS. 10 and 11. In FIG. 10, the mounting plate 930 is generally oval in configuration having opposing outwardly extending lips 980 raised from the rear surface 940 of the backside 20 of helmet 10 as shown in FIG. 9. An arrow indication 1000 on the mounting plate is for orientation purposes.

In FIG. 11, the device 30 has a corresponding female coupling bracket 1100 formed on the back of housing 910 wherein a locking chamber 1110 is formed. The female bracket 1100 corresponds in shape to the coupling bracket 930 having a slightly larger internal periphery so that the coupling bracket 1100 fits over the male coupling bracket 930. Correspondingly orientation arrow 1120 is provided showing the top of device 30. In operation, arrow 1120 is oriented with arrow 1000 and device 30 is placed over the coupling bracket. The device 30 is then turned in the direction of arrow 1130 to firmly lock the device over the coupling bracket 930. When fully twisted ninety degrees in the direction of arrow 1130, the lips 980 snap into place. A detent 1140 on the female coupling bracket 1100 at point 1140 is provided so that when device 30 is rotated nipple 1010 on lip 980 engages detent 1140 to hold the device firmly in place. It is to be expressly understood that any conventional means of mounting the device 30 to surface 940 could be utilized and that the approach shown in FIGS. 9 through 11 is exemplary of one approach.

Figure 12:
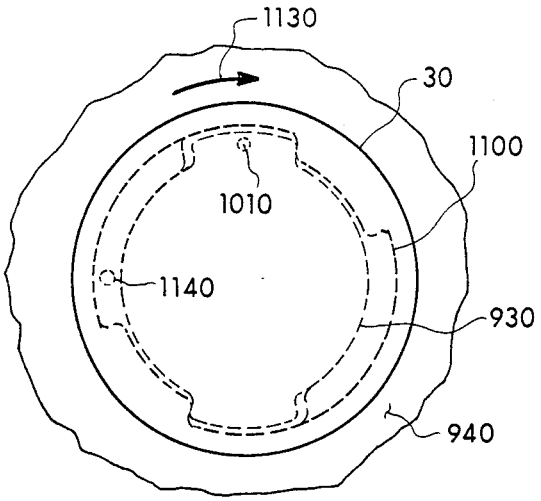
FIG. 12 is an illustration showing the device of the present invention fitting over the mounting plate of the present invention.
Figure 13:
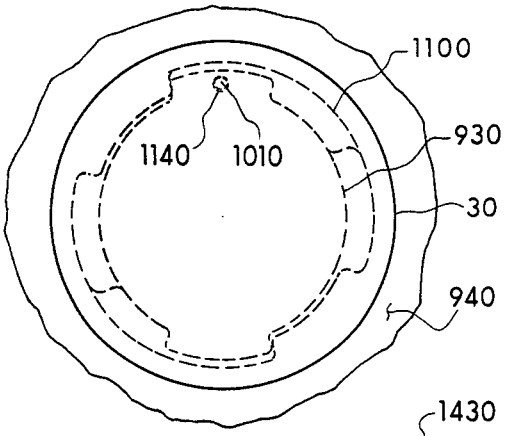
FIG. 13 is an illustration showing the locking of the device of the present invention to the mounting plate of the present invention.

In FIGS. 12 through 15, the method in assembling the device 30 to the mounting plate 930 is set forth. In FIG. 12, the device 30 with its female coupling bracket 1100 is placed over the male mounting bracket 930 and then twisted in the direction of arrow 1130. In FIG. 13, the device 30 is shown in the fully locked position.

Figure 14:
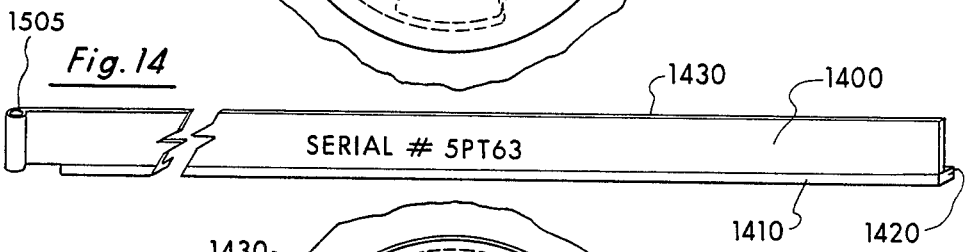
FIG. 14 sets forth the details of an identification strip in side planar view that fits around the housing of the present invention.
Figure 15:
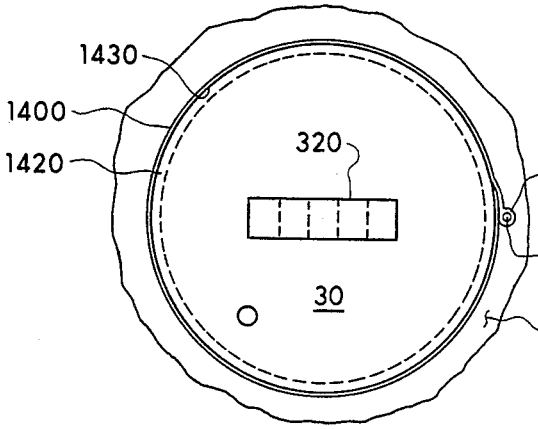
FIG. 15 is a rear planar illustration showing the affixation of the identification tape of FIG. 14.

In FIG. 14, a tamper proof retaining strap 1400 having a lower portion 1410 with an inwardly extending lip 1420 is now placed around the outer circumference of the device 30 so that the lip 1420 fully engages the channel 905. A formed sleeve 1505 at one end of the strap engages the pin 975 on the mounting plate 930. An adhesive backing 1430 firmly holds the retaining strap 1400 in place. The serial number on the retaining strap 1400 matches the serial number of the device and cannot be removed. The device and the retaining strap serial numbers are recorded under the athlete's name in the school files and the athlete must wear the protective gear in practice and all competition plays. Any removal of the strap 1400 permanently alters the strap through destruction of a portion thereof. This is so because the nipple 1010 rests firmly in detent 1140 when device 30 is properly installed on helmet. Sleeve 1505 of retainer strap 1400 slips over bracket pin 975 before the strap is secured as described above. Hence, the device 30 cannot be further rotated without destroying the retainer strap. The coach or other designated official can then monitor the level of activity, as previously discussed, on monitor 320. Even though an athlete appears to be in fine physical condition, if the indicator 320 shows that an athlete has achieved his accumulated force as discussed with respect to FIGS. 6 through 8, the athlete is "benched" until the indicator drops to a lower value thereby permitting the athlete to once again resume play.

It is to be expressly understood that in addition to the electrical bar indicator shown in FIGS. 3 through 5, a suitable electronic digital display or a mechanical display could also be utilized such as a rotating indicator disk or a rotating indicator drum cylinder.

Figure 16:
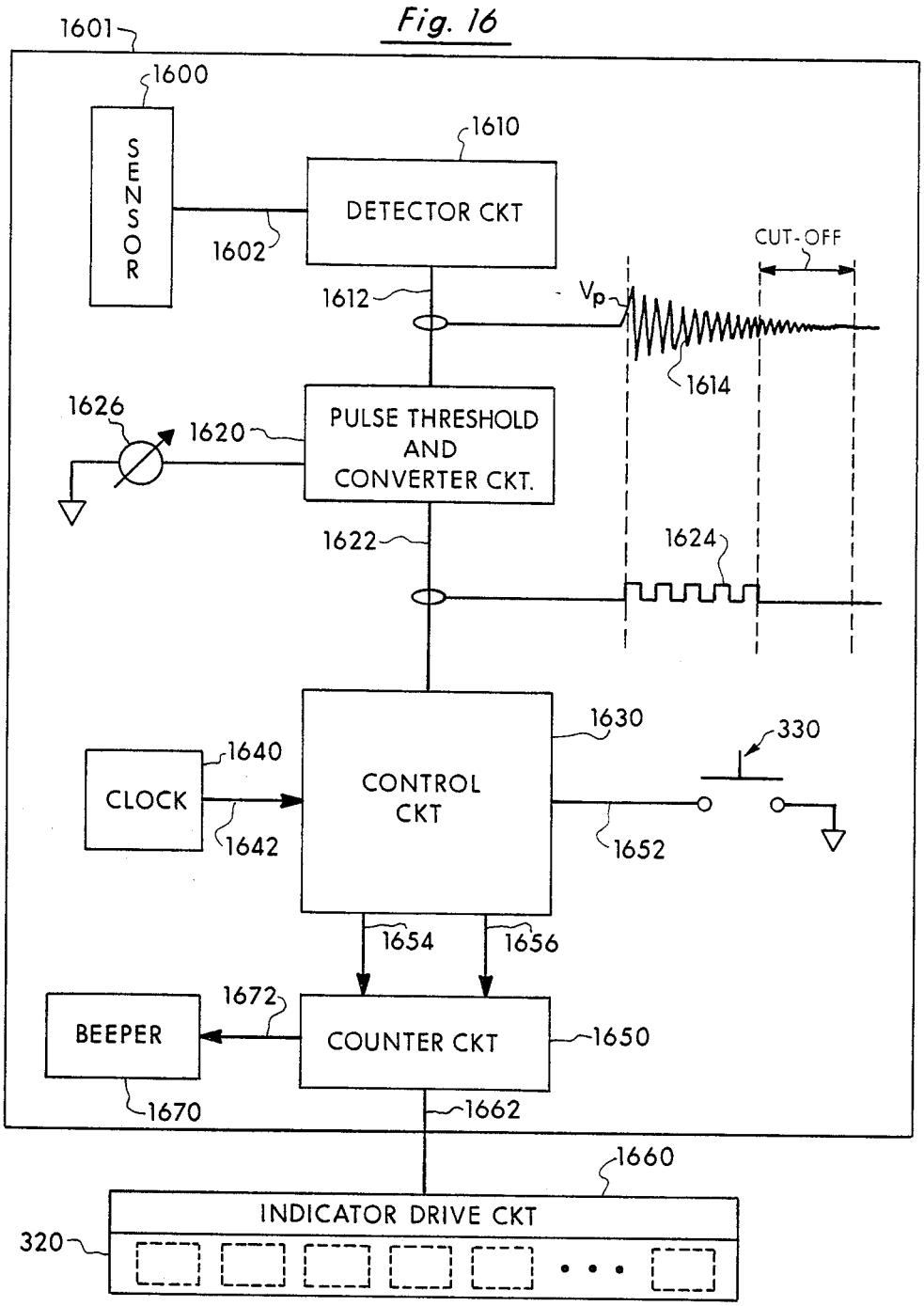
FIG. 16 is a schematic diagram of the electronics of the present invention.

In FIG. 16, the details of the electronics circuitry 1601 within the device 30 are set forth. A sensor 1600 is connected over line 1602 to a detector circuit 1610. The sensor 1600 is conventional and corresponds to the type of circuit set forth in FIGS. 2 and 3 of my earlier U.S. Pat. No. 4,534,557. Such a sensor measures both tensional and compressional forces. The detector circuit 1610 is also conventionally available and is of the type manufactured by Radio Corporation of America (RCA), Harrison, N.J. 07029 as Model CA3010 and wired as a detector. The detector circuit 1610 amplifies the signal from the sensor 1600 and as shown by curve 1614, the signal is an analog "ringing" signal that exponentially decays down to a barely discernible figure. The detector circuit 1610 is connected over line 1612 to a pulse threshold and converter circuit 1620 which in turn is connected over line 1622 to a control circuit 1630. The pulse threshold and converter circuit 1620 is conventionally available such as that from RCA as Model CA3010 (wired as a threshold circuit) to provide a window as shown by curve 1624 only when the signal 1614 is above a threshold value $V_P$. The signal below the threshold value $V_P$ is not processed.

As witnessed in FIG. 16, the output of the detector circuit 1610 on line 1612 is an exponentially decaying analog signal corresponding to the shock or force vibrations sensed by sensor 1600. The output of the pulse threshold and converter circuit 1620 is a digital signal 1624. The pulse threshold and converter circuit 1620 activates and produces a digital output 1624 on line 1622 only when the analog value of the signal 1614 exceeds a predetermined level, $V_p$. This predetermined value, $V_p$ can be selectively varied through manual adjustment of control 1626.

The control circuit 1630 receives clock signals from an oscillator 1640 over line 1642. The control circuit 1630 is connected to a push button switch 330 over line 1652 which functions to test the circuit at any given time. The circuit contained within device 30 contains its own conventional self-contained battery power source, not shown.

The control circuit 1630 is further interconnected to a counter circuit 1650 over lines 1654 and 1656. In the presence of a force, a signal is generated on line 1654 and causes the counter circuit 1650 to count up. Over a period of time, control circuit 1630 issues signals on line 1656 to cause the counter circuit 1650 to count down. The counter circuit 1650 is conventionally available such as that from RCA as Model Nos. 4020 and 4193. The counter circuit 1650 drives an indicator drive circuit 1660 over line 1662. The indicator drive circuit 1660 is connected to the indicator 320 previously discussed.

In addition, the control circuit 1630 is interconnected over line 1642 to a master clock timing circuit which is conventionally comprised of Texas Instruments (Richardson, Tex.) Part Nos. NE555 and UA2240C conventionally wired to produce such timing signals.

The indicator 320 is conventional liquid crystal display technology such as products manufactured by Hamlin Corporation, Lake & Crove Streets, Lake Mills, Wis. or IEE Corporation, 7740 Lemona Avenue, Van Nuys, Calif. which is custom built for such display purposes and wired with appropriate conventional drive electronics to function as above described. In addition, the counter circuit 1650 is connected to a beeper circuit 1670 over line 1672 so that when the counter circuit 1650 exceeds a predetermined count, a signal is generated on line 1672 to activate an audible beeper signal thereby indicating to the user of the device that a predetermined high limit, such as that shown in FIGS. 6 through 8, has been exceeded. This beeper is the type such as is conventionally available from Mallory Corporation, 3029 East Washington Street, Minneapolis, Minn. as Part No. MCP32032.

Figure 17:
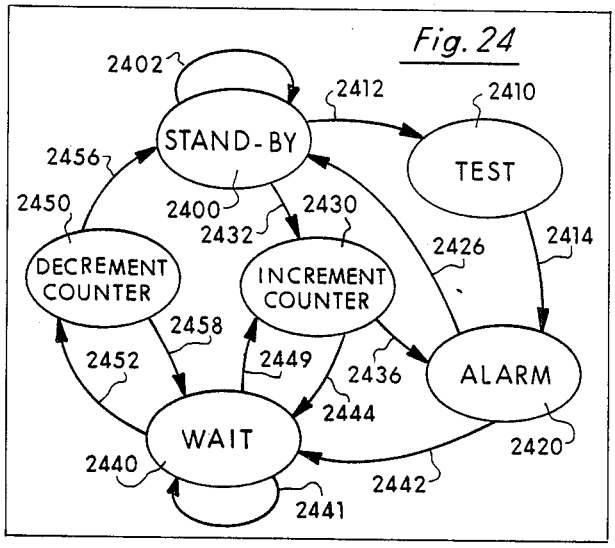
FIG. 17 sets forth the flow diagram for the control circuit of the present invention shown in FIG. 16.
Figure 17:
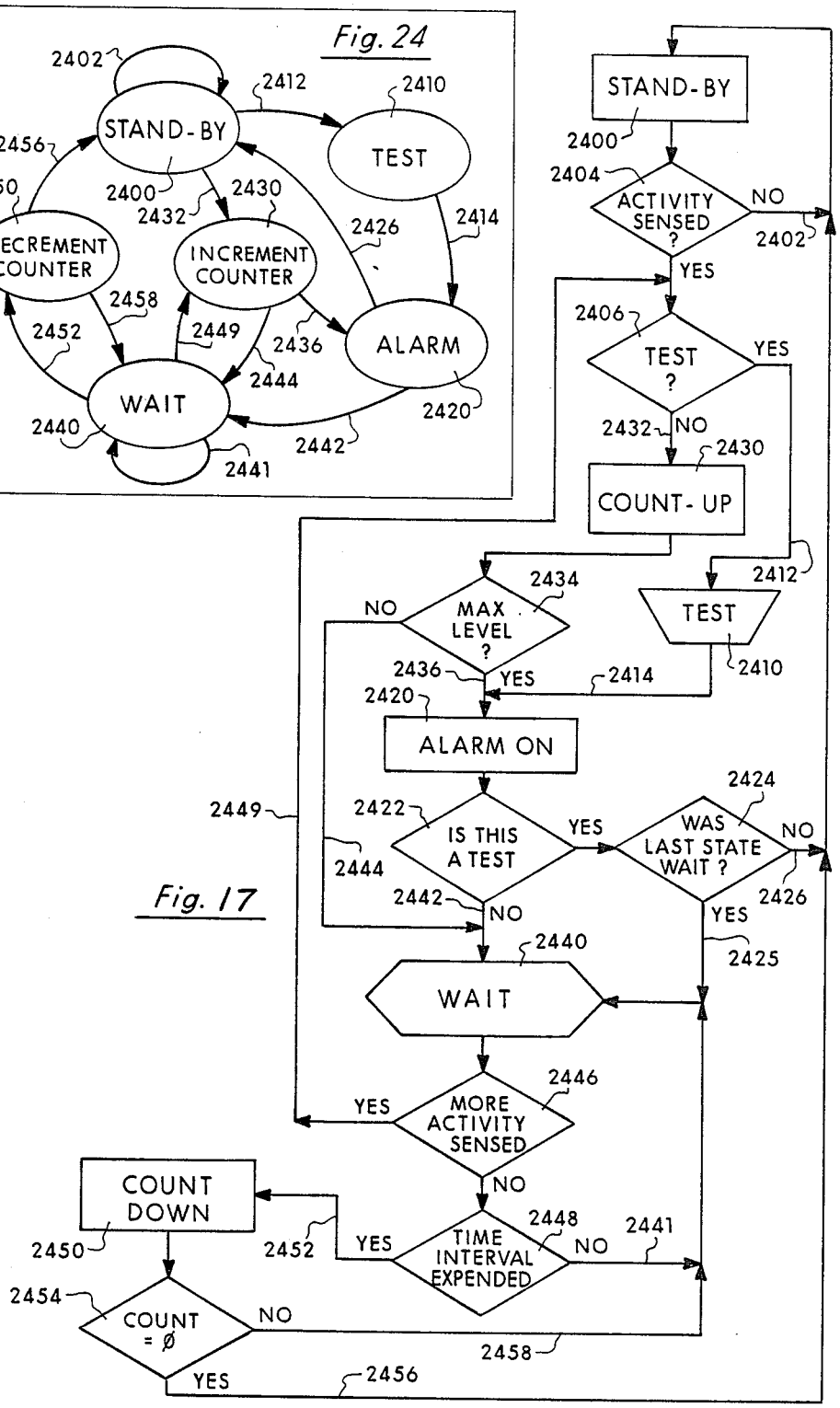

In FIGS. 17 and 24, are set forth the flow chart and state table for the operation of the control circuit 1630. The control circuit 1630 is conventional and is comprised of a circuit such as a conventional microprocessor circuit which is process driven according to the following state table and flow chart.

In FIG. 17 and 24, the following occurs. The circuit 1630 in FIG. 16 normally exists in a standby state 2400. It continues to cycle in the standby state 2400 by following path 2402. In FIG. 17, it continually determines whether or not an activity has been sensed in stage 2404. If not, it continues the loop 2402.

One activity which can be sensed, of course, is the pressing of the test button 330. Hence, the determination is made in stage 2406 whether or not the activity that is being sensed is the test button 330. If so, a test state 2410 is entered over line 2412. As a direct result of entering the test state 2410, the alarm state 2420 is entered over path 2414. Once in the alarm state 2420, a determination is made at stage 2422 as to whether or not a test is in progress. Since it is, stage 2424 is entered to determine whether or not the last state of the system is the "wait" state. Since it is not, the system returns to standby over line 2426.

In the event an activity other than a test is sensed, such as a detected force, the standby state 2400 enters the increment counter state 2430 over path 2432. It is in this state, that the counter circuit 1650 is incremented over path 1654 shown in FIG. 16. If a maximum level for the counter count up state 2430 is detected in stage 2434, the alarm state is entered over path 2436. Again, this enters the alarm state 2420, however, in this case, the determination made by state 2422 as to whether or not this is a test is negative and the wait state 2440 over path 2442 is entered. Likewise, if the maximum level in stage 2434 is not determined, the wait state 2440 is entered over path 2444.

In the wait state 2440, control circuit 1630 receives the clock pulses over path 1642 from clock 1640. If no more activity is sensed in stage 2446, then a determination is made in stage 2448 as to whether or not the time interval has expended in order to decrement the counter 1650. If it has, decrement counter state 2450 is entered to decrement the counter 1650 over line 1656. The decrement counter state 2450 is accessed over path 2452. If the count in stage 2454 equals zero, the standby state 2400 is accessed over path 2456. If not, the system returns to the wait state 2440 over path 2458. If in state 2440, more activity is sensed in stage 2446, then the system returns to the increment counter state 2430 over path 2449. As can be witnessed in FIGS. 17 and 24, if a test occurs during the wait state 2440, the system cycles back to the wait state 2440 as determined by stage 2424 over path 2425. The system remains in state 2440 if no further activity is sensed and a negative determination is made in the time interval expended stage over path 2441.

In this fashion, the system can properly increment and decrement the counter circuit 1650 according to the predetermined force-time pattern previously discussed.

Figure 18:
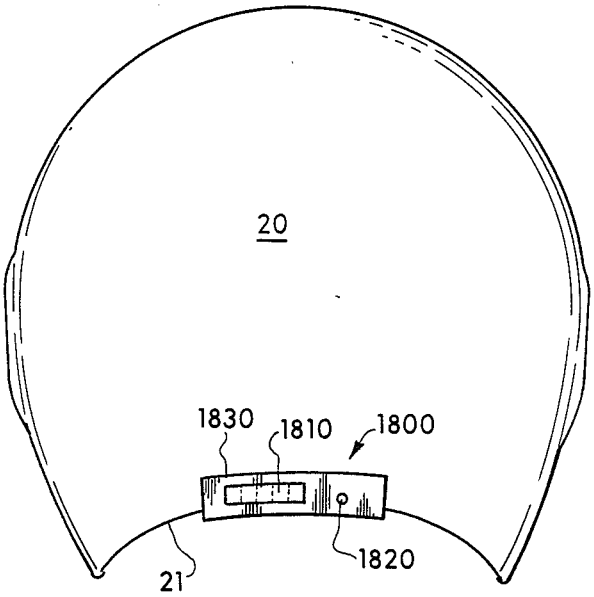
FIG. 18 is a side planar view of a football helmet having attached thereto a second embodiment of the device of the present invention.

In FIGS. 18–23 is shown a second embodiment of the present invention. In FIG. 18, the football helmet backside 20 has mounted to the lower rear edge 21 thereof the device 1800 of the second embodiment. The device 1800 includes a digital indicator 1810 and a test button 1820. It also includes a housing 1830.

Figure 19:
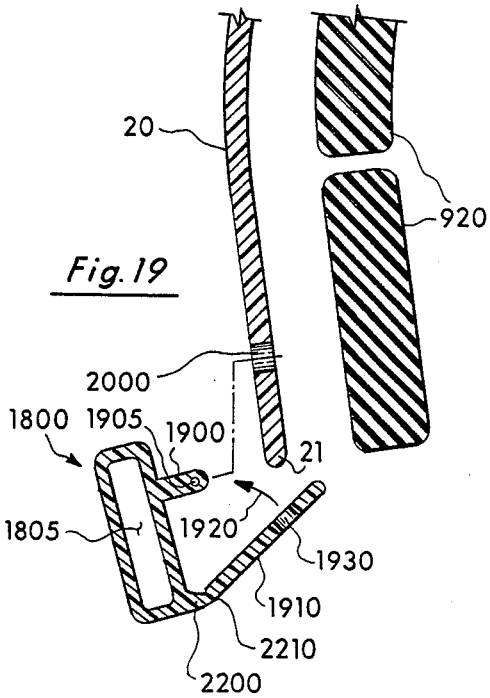
FIGS. 19 and 19(*a*) set forth in cross-sectional view, the interconnection of the device shown in FIG. 18 to a football helmet.
Figure 19A:
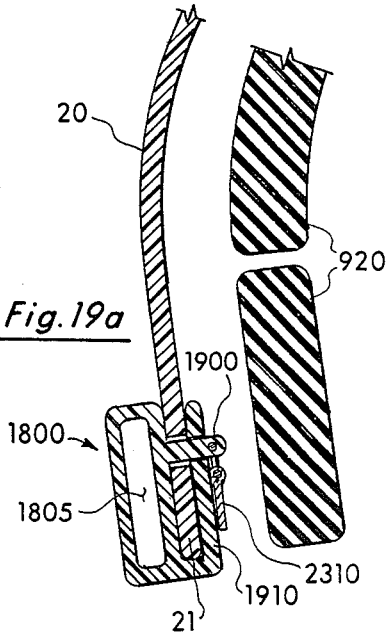

As shown in FIG. 20, two holes 2000 and one hole 2010 is drilled in a region near the rear edge 21 of helmet 20. As shown in FIG. 19, holes 2000 are receptive of a pin 1900 molded into housing 1800. The pin 1900 fits through the hole 2000 and a flexible lip 1910 extending the entire length of the housing 1800 is moved upwardly in direction of arrow 1920. A formed hole 1930 in the lip 1910 positions over the end of pin 1900 to sandwich the rear edge 21 between the housing 1800 proper and lip 1910 as specifically shown in FIG. 19A. This is better shown by reference to FIG. 21 which is a top view showing the pins 1900 entering through holes 2000 of edge 21. The third formed hole 2010 in the edge 21 is receptive of a screw 2100 through formed hole 2110 of the lip 1910. This engages a corresponding nut 2120 firmly affixed to the interior of the housing 1800 as shown in FIG. 21. In this fashion, the housing 1800 can be easily mounted to the edge of the football helmet wherein the screw 2100 firmly holds the housing in place. As shown in FIG. 22, the indicator 1800 is a digital indicator of the type earlier discussed.

In this embodiment, the housing 1800 holding electronics in cavity 1805 is substantially rectangular in shape as shown in FIG. 22 having a downwardly extending portion 2200 engaging the flexible lip 1910 with a living type hinge 2210. A wire lock 2300 is provided which engages the holes 1905 formed in each pin 1900. The wire lock 2300 can have a serial number identification formed as part of the wire lock and as shown as 2310 in FIG. 23, which is viewed from inside the helmet.

It is to be expressly noted that while individual components have been set forth and discussed for electronics shown in FIG. 16, in the preferred embodiment, the electronics will be microminiaturized onto a single chip.

While the preferred embodiments of the present invention have been shown, it is to be expressly understood that modifications and changes may be made thereto and that the present invention is set forth in the following claims.

I claim:

1. A device for displaying accumulated force encountered by a participant (40) wearing protective gear (10) in a sporting event so that the participant will not sustain a harmful amount of accumulated force over a period of time, said device comprising:

a housing affixed to said protective gear, means (1600, 1610, 1620) contained in said housing for sensing the magnitude of forces encountered by said protective gear, said sensing means also generating a signal (1624) proportional to the magnitude of each said force above a predetermined value, $(V_p)$, means (1630, 1640, 1650) in said housing, connected to said sensing means and receptive of said signals from said sensing means for determining the amount of accumulated force encountered by said protective gear over said period of time from said forces, said determining means also simultaneously decrementing said value of said accumulated force according to a predetermined force-time pattern (620) thereby allowing time for said participant to recover, and means (1660, 320) on said housing interconnected with said determining means for displaying said accumulated force (610).

2. The device of claim 1 further comprising means (1670) in said housing and connected to said determining means for issuing an alarm when said accumulated force exceeds a predetermined amount.

3. The device of claim 1 in which said housing is removably connected to said protective gear.

4. The device of claim 3 further comprising:

means (1400) selectively engaging said housing for preventing the removal of said sensing means from said protective gear unless said preventing means is permanently altered.

5. The device of claim 4 wherein said preventing means carries a unique serial number.

6. A device for displaying accumulated force encountered by a participant (40) wearing protective gear (10) in a sporting event, so that the participant will not sustain a harmful amount of accumulated force over a period of time, said device comprising:

a housing affixed to said protective gear, said housing being selectively removable from said protective gear, means (1600, 1610, 1620) contained in said housing for sensing the magnitude of forces encountered by said protective gear, said sensing means also generating a signal (1624) proportional to each said force above a predetermined value, $(V_p,)$ means (1630, 1640, 1650) in said housing, connected to said sensing means and receptive of said signals from said sensing means for determining the amount of accumulated force encountered by said protective gear over a period of time from said forces, said determining means also simultaneously decrementing said accumulated force according to a predetermined force-time pattern (620) thereby allowing time for said participant to recover, means (1670) in said housing and connected to said determining means for issuing an alarm when said accumulated force exceeds a predetermined amount, and means (1400) selectively engaging said housing for preventing the removal of said sensing means from said protective gear unless said preventing means is permanently altered, said preventing means having a unique serial number placed thereon.

7. A device for displaying accumulated force encountered by a participant (40) wearing a protective helmet (10) so that the participant will not sustain a harmful amount of accumulated force over a period of time, said device comprising:

a connector (930) attached to said helmet, a housing (910) removably engaging said connector, means (1400) selectively engaging said housing and said connector for preventing the removal of said housing from said connector unless said preventing means is permanently altered, means (1601) in said housing for sensing the magnitude of forces encountered by said helmet, said sensing means also determining the amount of said accumulated force encountered by said protective helmet over a period of time from said forces, and means (1660, 320) on said housing interconnected with said determining means for displaying said accumulated force.

8. The device of claim 7 wherein said sensing means further decrements said accumulated force according to a predetermined force-time pattern thereby allowing time for said participant to recover.

9. The device of claim 7 in which said sensing means is removably connected to said protective gear.

10. A device for displaying accumulated force encountered by a participant (40) wearing football helmet gear (10) in a sporting event so that the participant will not sustain a harmful amount of accumulated force over a period of time, said device comprising:

a housing means (1600, 1610, 1620) in said housing for sensing the magnitude of forces encountered by said helmet, said sensing means also generating a signal (1624) proportional to each said force above a predetermined value, ($V_p$,)

means removably connecting said housing to said football helmet, means (1630, 1640, 1650) in said housing receptive of said signals from said sensing means for determining the amount of said accumulated force encountered by said helmet, said determining means also simultaneously decrementing said value of said accumulated force according to a predetermined forcetime pattern (620) thereby allowing time for said participant to recover, and means (1660, 320) on said housing interconnected with said determining means for displaying said accumulated force (610).

11. The device of claim 10 further comprising means (1670) in said housing connected to said determining means for issuing an alarm when said accumulated force exceeds a predetermined amount.

12. The device of claim 10 further comprising:

means (1400) selectively engaging said housing for preventing the removal of said housing from said helmet unless said preventing means is permanently altered.

13. A device for displaying accumulated force encountered by a participant (40) wearing football helmet gear (10) in a sporting event so that the participant will not sustain a harmful amount of accumulated force over a period of time, said device comprising:

a housing means (1600, 1610, 1620) in said housing for sensing the magnitude of forces encountered by said helmet, said sensing means also generating a signal (1624) proportional to the magnitude of each said force above a predetermined value, ($V_p$,)

means removably connecting said housing to said football helmet, means (1630, 1640, 1650) in said housing receptive of said signals from said sensing means for determining the amount of said accumulated force encountered by said helmet, means (1660, 320) on said housing interconnected with said determining means for displaying said accumulated force (610), means (1670) in said housing connected to said determining means for issuing an alarm when said accumulated force exceeds a predetermined amount, and means (1400) selectively engaging said housing for preventing the removal of said housing from said helmet unless said preventing means is permanently altered.

14. The device of claim 13 wherein said determining means is simultaneously and selectively capable of decrementing said accumulated force according to a predetermined time-force pattern thereby allowing time for said participant to recover.

* * * * *